US005638545A

United States Patent [19]

Rosner

[11] Patent Number: 5,638,545

[45] Date of Patent: Jun. 17, 1997

[54] ARTICLE FOR RADIOLOGY PROTECTION

[76] Inventor: Neal H. Rosner, 2852 Harolds Cr., Flossmoor, Ill. 60422

[21] Appl. No.: 529,510

[22] Filed: Sep. 18, 1995

[51] Int. Cl.[6] ..... A41D 13/08; G21F 3/02

[52] U.S. Cl. ..... 2/16; 2/161.7; 250/516.1

[58] Field of Search ..... 2/16, 160, 161.6, 2/161.7, 167, 20, 159, 164; 250/516.1, 519.1, 515.1

[56] References Cited

U.S. PATENT DOCUMENTS

| | | | |
|---|---|---|---|
| 1,611,031 | 12/1926 | Henderson | 250/519.1 |
| 1,689,212 | 10/1928 | Picker | 2/168 |
| 2,312,921 | 3/1943 | Lubow | 250/516.1 |
| 2,328,105 | 8/1943 | Strobino | 250/516.1 |
| 2,749,448 | 6/1956 | Appelbaum et al. | 250/516.1 |
| 3,569,713 | 3/1971 | Via, Jr. | 250/516.1 |
| 4,220,867 | 9/1980 | Bloch, Jr. | 250/516.1 |
| 4,355,424 | 10/1982 | McCoy, Jr. | 2/167 |
| 5,099,135 | 3/1992 | Gemmill | 250/516.1 |
| 5,523,581 | 6/1996 | Cadwalader | 250/516.1 |

FOREIGN PATENT DOCUMENTS

| | | | |
|---|---|---|---|
| 0800115 | 8/1958 | United Kingdom | 250/516.1 |

OTHER PUBLICATIONS

"X-Ray Supplies & Accessories", pp. 1–10, Atomic Products Corporation., Jan. 1990.

"Diagnostic Imaging Products", pp. 1–13, AliMed, Inc., Aug. 1995.

*Primary Examiner*—Amy B. Vanatta

*Attorney, Agent, or Firm*—Laff, Whitesel, Conte & Saret, Ltd.

[57] ABSTRACT

An insert for surgical glove has a flexible, generally planar member which includes material that attenuates x-rays or other ionizing radiation. The insert can be attached to a medical practitioner's hand to protect the medical practitioner against undesirable radiation during the performance of medical procedures without limiting the dexterity or tactile sensitivity of the fingers. The low profile of the planar member allows a surgical glove to be worn over the insert to maintain a sterile environment during medical procedures. The radiation-inhibiting material may include a plurality of lead-vinyl sheets held in a sheath. The sheath is removably insertable into a cloth pocket to form the flexible planar member. The member is attached to the medical practitioner's hand by using an adjustable strap.

19 Claims, 3 Drawing Sheets

37
27
27
55
49
53
41
53
51
48
48
45
25
47
43
43
43
43

ARTICLE FOR RADIOLOGY PROTECTION

FIELD

This invention relates to articles which prevent exposure to ionizing radiation resulting from medical procedures and, more particularly, to an article for protecting the hands during radiology procedures.

BACKGROUND

It is well known that the risk of cancer from radiation exposure is proportional to the total amount of radiation received over a lifetime. In the early days of radiology, for example, those who worked extensively in developing the science of using X-rays have been referred to as "martyrs of radiology" in that due to their work, many of them developed carcinomas, especially in their hands and upper extremities, which led to their eventual deaths.

Since that time, much more is known about the results of radiation exposure over time and the associated risks of radiation-induced cancer. Various technologies have been developed to limit the time and amount of exposure to ionizing radiation, both for the patient and for those administering x-ray or fluoroscopic procedures. For example, those parts of the patient which are not to be exposed to radiation are routinely covered by a blanket or shield which is made of a material which radiation does not penetrate. Although in the past the material used for such blankets or shields has been lead, various lead-equivalent materials have been developed which also inhibit radiation from passing through them, such as lead-vinyl sheets.

Medical personnel performing x-ray or fluoroscopic procedures often have radiology aprons made of lead or lead-equivalent material to be worn in the same manner as a conventional apron, thereby shielding the torso and mid-section of the practitioner's body. These radiology aprons, however, suffer from various drawbacks and disadvantages. For example, the radiology aprons generally afford little or no protection to the upper extremities of the practitioner's body, especially the arms, including hands, wrists, forearms. Such a drawback is especially significant because the hands, wrists, and forearms of the practitioner are most likely to be inadvertently exposed to radiation since they are in closest proximity to the radiation emissions during radiography, fluoroscopic, or the myriad other procedures involving radiation used in medical practice today.

One attempt to reduce exposure of the upper extremities to harmful radiation has been the provision of gloves impregnated with a lead-equivalent material. This solution, however, suffers from further drawbacks and disadvantages. For example, the impregnated material used in such gloves renders them generally thicker than normal surgical gloves and therefore, limits dexterity and tactile feedback, both of which are of extreme importance when operating medical apparatus or performing medical or surgical procedures involving radiation. In addition, the protection against radiation from such gloves is generally undesirably limited. For example, the degree of shielding may be so minimal that the bones of a hand wearing the impregnated glove are readily visible if the gloved hand were to be radiographed. Attempts to make gloves out of thicker shielding material not only further reduce the dexterity and tactile feedback, but cause the gloves to become loose and less form-fitting, making them even more unsuitable for use in medical or surgical procedures.

The increasing use of radiation in performing medical treatments is magnifying the drawbacks of the current art of radiation protection. Interventional procedures developed over the last 15 years more regularly expose a wider range of medical practitioners to much greater doses of radiation over their lifetimes. Such procedures include angiograms and angioplasty, placement of stents, nephrostomy, biliary drainage, abdominal procedures, the TIPS procedure, interventional radiology, and radiation oncology.

The harm to the hands of medical workers performing the increasing number of radiographic and fluoroscopic procedures will not be appreciated until it is too late, since the latency for developing carcinoma to the skin of the hands is often greater than 20 years. As such, the effects of increased exposure to radiation procedures developed in the last 15 to 20 years are not known.

Accordingly, there is a need for an article which adequately protects the hands of medical practitioners from exposure to ionizing radiation during performance of those medical procedures B which employ radiation. There is a further need for the hands to be shielded from radiation without losing dexterity or tactile sensitivity.

SUMMARY

Accordingly, an object of this invention is to provide an article which protects a medical practitioner's upper extremity, such as the hand and wrist, from exposure to radiation.

Further, it is an object of this invention to maintain sufficient dexterity and tactile response in the hand that is associated with the article so that the invention does not detract from the ease of performing the medical procedure.

Another object is to make the article easy for the medical practitioner to attach to and remove from his or her hand, thereby encouraging usage of the article in all radiological procedures.

According to the present invention, the foregoing and other objects and advantages are attained by an article for use at the hand, wrist, or forearm during procedures involving ionizing radiation. The article has a substantially flat, flexible member which is made out of a material that attenuates x-rays or other radiation. The surface area of this member is large enough to cover the hand, wrist, and/or forearm which is likely to be exposed to the radiation. The member is capable of being attached to the selected location of the upper extremity without reducing the dexterity of the fingers. Attachment of the flat member to the upper extremity may be accomplished by means of an adjustable-length strap.

According to one aspect of the invention, the article comprises an insert for a glove. The insert has a flexible, planar member made of lead-equivalent material and a layer of cloth substantially overlying the lead-equivalent material. The lead-equivalent member and the layer of cloth are sufficiently thin to permit a glove to be worn over the insert.

According to another aspect of the invention, the cloth material may be formed into a resealable pocket and the flat, lead-equivalent member may be kept in the pocket. The lead-equivalent member may include sufficient lead-equivalent material so as to provide protection against radiation equivalent to one-half millimeter of pure lead.

Still other objects, advantages, and novel aspects of the present invention will become apparent in the detailed description of the invention that follows, in which the preferred embodiment of the invention is shown by way of illustration of the best mode contemplated for carrying out the invention, and by reference to the attached drawing in which:

DESCRIPTION

Figure 1:
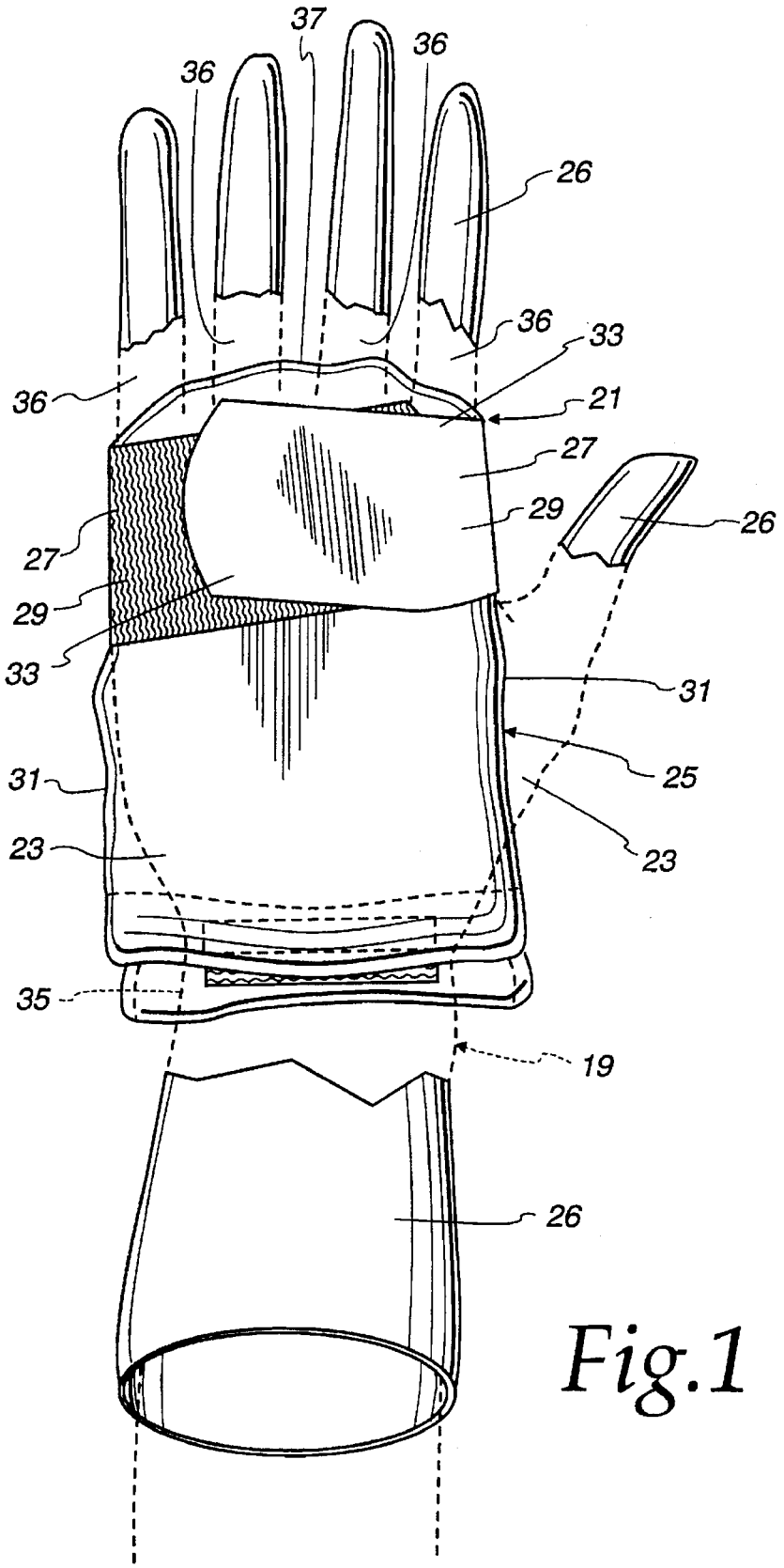
FIG. 1 is a top plan view of an article according to the present invention, the article being secured to a hand wearing a surgical glove.

As shown in FIG. 1, an article 21 for use on an upper extremity 19 of the body comprises an insert which can be worn on the user's hand 23 underneath a conventional surgical glove 26. The article 21 includes a substantially flat, flexible member 25 and means, here shown as an adjustable-length strap 27, for releasably securing the member 25 to the user's hand 23, preferably to the palm. The article 21 could also be attached to the back of the hand when appropriate for the contemplated medical or surgical procedure. The member 25 has a surface area which is sufficient to cover a predetermined location of the extremity 19 likely to be exposed to ionizing radiation, such x-rays; in this embodiment, the member 25 is sized to cover at least the palm or metacarpus of the user.

Referring to FIGS. 1–5, the strap 27 is in two pieces and has a first pair of ends 29 attached at opposite sides 31 of the member 25. A second pair of ends 33 are remote from the member 25 a sufficient distance so that ends 33 can be wrapped around the user's hand and attached to each other, as shown in FIG. 1, on the side of the hand opposite the planar member 25. The ends 33 are secured to each other by any suitable means, such as hook and eye fasteners.

Figure 2:
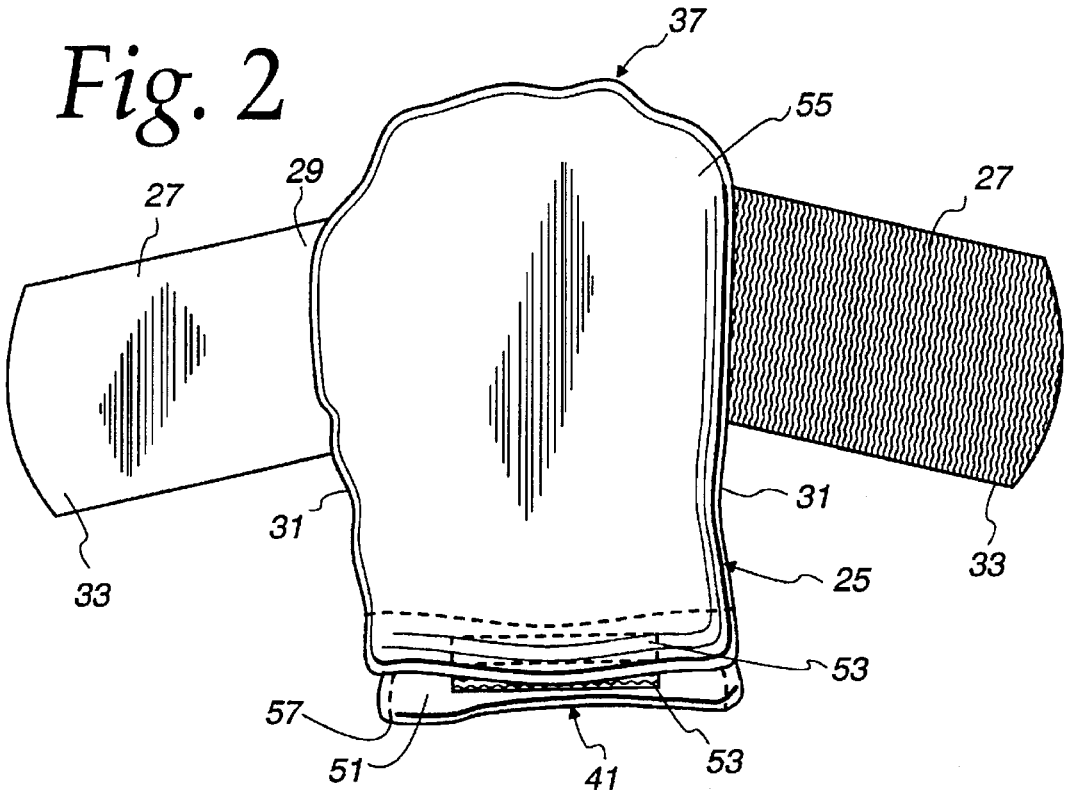
FIG. 2 is a top plan view of the article of FIG. 1 removed from the hand.

As best seen in FIGS. 1 and 2, the strap 27 is connected to the member 25 at a location along the member's sides 31 so that, when the article 21 is secured to the user's hand, forward edge 37 of the member 25 is located at or near the base of the user's fingers 39. At the same time, rear edge 41 of the member 25 is located at or below the user's wrist 35. The planar member 25 thus substantially covers the user's palm and wrist when the article 21 is secured to the user's hand 23.

Figure 3:
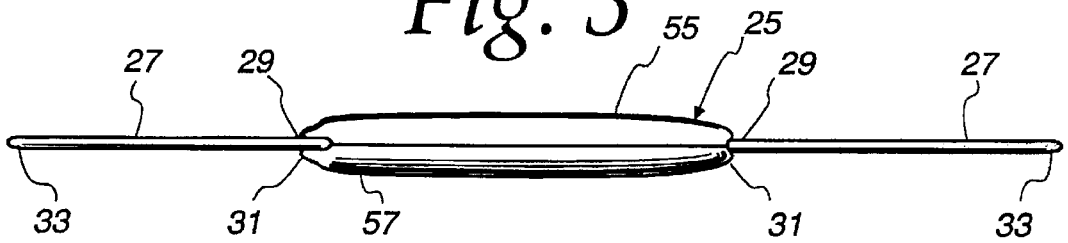
FIGS. 3–5 are front, back, and side elevational views, respectively, of the article of FIGS. 1 and 2.
Figure 4:
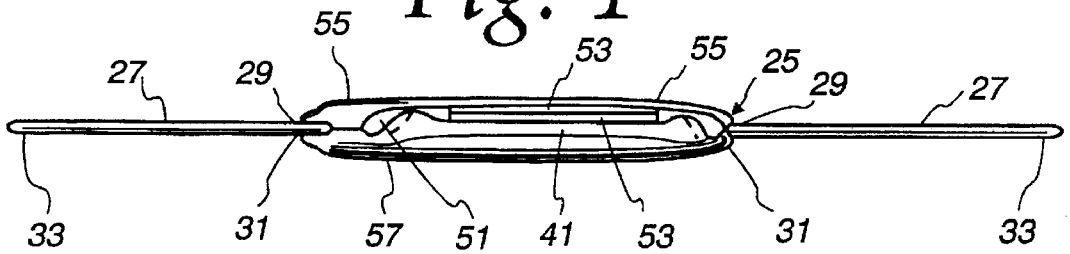
Figure 5:
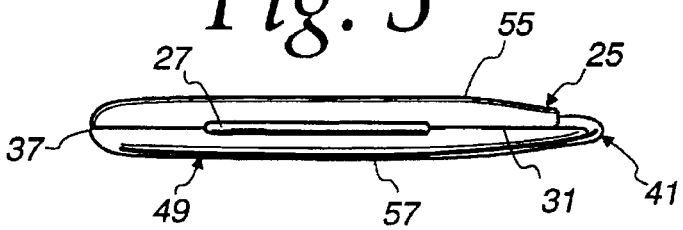

The planar member 25 is formed using material that inhibits passage of ionizing radiation therethrough. Ionizing radiation refers to x-rays and any other radiation which harms tissue by ionizing, including without limitation the radiation from isotopes used in oncology and other medical procedures. In this application, it is to be understood that, although reference may be made to the ability of the article 21 to inhibit or attenuate x-rays, such inhibiting or attenuating characteristics of the article 21 apply equally to all other types of ionizing radiation. The location of the forward edge 37 of the member 25 at the base of the fingers 39 thus protects a substantial portion of the user's hand, particularly the palm, from exposure to x-rays or other radiation without reducing dexterity of the fingers 39. As best seen in FIGS. 3–5, the article 21 has a low profile, so the user can put on and wear a conventional surgical glove 26 over the article 21.

Figure 6:
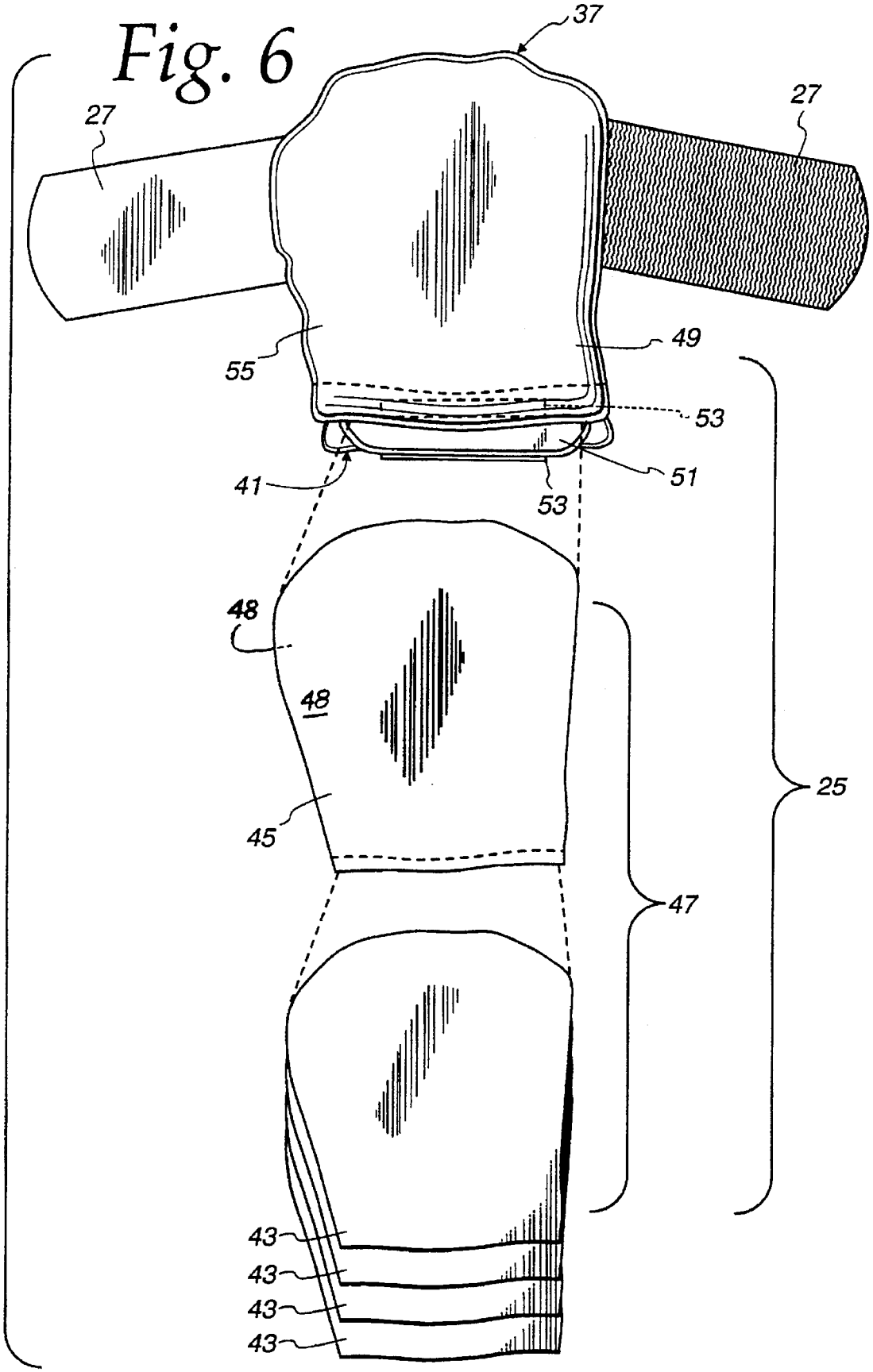
FIG. 6 is an exploded, perspective view of the article of FIGS. 1–5.

Referring to FIG. 6, the radiation inhibiting material of the member 25 comprises a plurality of lead-vinyl sheets 43 which are stacked atop each other and held in a vinyl sheath 45. The lead-vinyl sheets 43 inhibit the passage of x-rays to which the user is exposed during various radiographic and surgical procedures. The sheath 45 and the lead-vinyl sheets 43 therein form a flexible, substantially planar member 47 with opposite planar surfaces 48 containing lead-equivalent material. The member 47 is removably received into a pocket or case 49. The pocket 49 is formed of cloth material and has a resealable opening 51 through which the lead-equivalent member 47 may be inserted or removed. When the member 47 is fully received in the pocket 49 and the opening 51 is sealed by any suitable means, such as by cooperating hook and loop fastener strips 53, the cloth material of the pocket is secured to contain the lead-equivalent member 47 and substantially overlies both the planar surfaces 48 of the member 47.

The lead-vinyl sheets 43 comprise a mixture of powdered metals, including powdered lead, which mixture is combined with a vinyl carrier. Such lead-vinyl sheets are commercially available for use in surgical aprons, and any of a variety of sheet thicknesses is suitable for the present invention. A preferable vinyl sheet thickness has been found to be one that provides protection against radiation equivalent to 0.167 millimeters of lead. When four such sheets are combined as shown in this embodiment, the member 47 includes sufficient lead-equivalent material to inhibit x-rays to substantially the same extent as one-half millimeter of lead. Such protection has been found suitable for most medical applications involving use of x-rays or radioisotopes.

Referring now once again to FIGS. 2–5, the pocket 49 in this embodiment has a planar surface 55 made of an absorbent material, preferably terry cloth, and an opposite planar surface 57 made out of a durable, fine-weave material, preferably canvas. The two opposite surfaces 55, 57 form the pocket 49 by being joined to each other at their edges, except at the opening 51 of the pocket 49. The use of absorbent material on one surface and durable material on the other surface of the pocket 49 allows the absorbent layer of the surface 55 to be positioned against the user's hand. Perspiration is thus absorbed and the user's comfort is enhanced. When the terry-cloth surface is against the user's hand, the opposite surface 57 faces outwardly. The durable layer of cloth, in this case canvas, on the outwardly facing surface 57 generally has a coefficient of friction less than terry cloth. This slippery characteristic allows the user to readily slip the form fitting elastic surgical glove 26 past the article 21.

Still referring to FIGS. 3–5, the strap 27 is sewn at the edges of the planar surfaces 55, 57. The strap ends 33 are remote from the pocket 49. A suitable material for the strap 27 is a flexible, woven, substrate on which are disposed hook and eye fasteners. The strap is suitably wide to avoid constricting the user's upper extremity 19 (FIG. 1) or otherwise causing discomfort. The flexible strap material has the advantage of conforming to the surface of the user's upper extremity and adapts to flexing or moving of the muscles therein while still maintaining the planar member 25 securely against the user's extremity.

The use of hook and eye fasteners along the length of the strap 27 allows the strap to be secured in multiple locations, thereby allowing different sizes of hands to be fit into the article 21. The length of the strap 27 is sufficient to allow the two portions of the strap 27 to wrap around the side of the user's hand opposite the planar member 25 and have the ends 33 of the strap 27 securable to each other in at least one of the multiple securing locations available. A suitable length for each of the two portions of the strap 27 has been found to be about 4" and an appropriate width has been found to be about 2".

The length and width of the planar surface of the member 25 are sufficient to cover the portion of the upper extremity to be protected from radiation. The width of the member 25, which corresponds to the distance between the opposite sides 31, is at least sufficient to position the sides 31 coextensively with the sides of the user's hand 23. Preferably, the width of the member 25 is selected so that the sides 31 of the member 25 extend at least partially around the sides of the user's hand.

The length of the member 25, which corresponds to the distance between the forward edge 37 and the rear edge 41, is sufficient so that when the forward edge 37 is positioned at the base of the fingers 39, the rear edge 41 extends to at least the base of the hand and, preferably, over the wrist. The article 21 may be constructed to have the planar member 25 in different sizes corresponding to the different sizes of typical users'hands. One size of the article 21 has the planar member 25 with a length of about 5½" and a width of about 4½.

An alternative embodiment of the present invention increases the length of the planar member 25 a sufficient amount to cover not only the palm and wrist, but also at least a portion of the forearm. This embodiment may be particularly suitable when generalized exposure to radiation may occur across a medical practitioner's hand and forearm at various times during the medical procedure.

Further alternative embodiments may substitute different means for attaching the planar member 25 to the user's upper extremity rather than the use of the adjustable strap 27, such as an elastic band. In still other alternative embodiments, the overall shape of the planar member 25 may be altered to follow the contour of that portion of the upper extremity needing protection from radiation.

In addition to the advantages apparent from the above description, the article of the present invention protects an upper extremity of a medical practitioner, particularly the hand, from exposure to radiation during performance of medical or surgical procedures which employ radiation. The protection from radiation is accomplished without undesirably limiting dexterity or tactile sensitivity of the medical practitioner's fingers.

As another advantage, the article of the present invention can function as an insert for a conventional surgical glove, thereby maintaining sterility while also protecting against radiation during medical procedures.

The article according to the present invention has the advantage of being easy for the medical practitioner to attach to and remove from his or her hand, thereby encouraging usage of the article in all radiological procedures.

As still another advantage, the lead-equivalent member of the article can be removed from its cloth pocket, thereby allowing the pocket to be machine-washed or otherwise cleaned without risking damage to the lead-equivalent member.

As yet another advantage, the article is easy to manufacture in a variety of sizes.

While the present invention has been described with references to a preferred embodiment thereof, illustrated in the accompanying drawings, various changes and modifications can be made by those skilled in the art without departing from the spirit and scope of the present invention. Therefore, the appended claims are to be construed to cover equivalent structures.

What is claimed is:

1. An article for use on an upper extremity of the body, including a hand, wrist, or forearm, during procedures involving ionizing radiation, the article comprising:

a substantially flat, flexible member which substantially inhibits the passage of the radiation therethrough, the member having a surface area which covers a selected location on the extremity likely to be exposed to the radiation, wherein the substantially flat member has a forward edge and a length and a width sufficient to cover at least the metacarpus, and means for releasably securing the member to the extremity without reducing dexterity of the fingers, said forward edge of the member positioned at the base of the fingers when said securing means are secured to the extremity.

2. The article of claim 1, wherein the member has a pair of opposite surfaces and is formed of cloth material, and radiation inhibiting material enclosed by said cloth material.

3. The article of claim 2, wherein the cloth material disposed adjacent the first surface is moisture-absorbent and the cloth material disposed adjacent the second surface has a coefficient of friction less than the cloth material adjacent to the first surface.

4. The article of claim 3, wherein the cloth material disposed adjacent the first surface is terry cloth and the cloth material disposed adjacent the second surface is canvas.

5. The article of claim 2 for use in X-ray procedures, wherein the cloth material comprises a case and the radiation-inhibiting material comprises at least one lead-vinyl sheet removably received in the case.

6. The article of claim 1, wherein the securing means comprises an adjustable-length strap.

7. The article of claim 6, wherein the strap comprises a first pair of ends connected to the substantially flat, flexible member and a second pair of ends remote from the member, the second ends adapted to be fastened to each other at one of multiple locations.

8. The article of claim 7, wherein the member has two opposing sides and the first pair of ends is attached to the member at its opposing sides.

9. An article for use on an upper extremity of the body, including a hand, wrist, or forearm, during procedures involving ionizing radiation, the article comprising:

a substantially flat, flexible member which substantially inhibits the passage of the radiation therethrough, the member having a surface area which covers a selected location of the extremity likely to be exposed to the radiation, wherein the substantially flat, flexible member has a length and width sufficient to cover at least the metacarpus of a hand, and a forward edge; and an adjustable-length strap for releasably securing the member to the extremity at the selected location without reducing dexterity of the fingers, and wherein the strap is connected on the member to position the forward edge of the member below the fingers.

10. The article of claim 9, wherein the member has opposing sides and the width of the member is sufficient to position the sides of the member around the sides of the hand.

11. A radiation-attenuating insert for a glove comprising:

a flexible, generally planar member of lead-equivalent material, wherein the generally planar member has a forward edge and a length and a width sufficient to cover at least the metacarpus;

a cloth material secured to the member and substantially overlying the member, the cloth material and the member each at least as large as the palm of a user's hand; and an adjustable length strap connected to the cloth material at spaced apart locations thereon to secure the cloth material and the flexible, generally planar member to the user's hand so that the forward edge is positioned at the base of the fingers.

12. The insert of claim 11, wherein the cloth material comprises a resealable pocket and the member is located in the pocket.

13. The insert of claim 12, wherein the member is removably received in the pocket.

14. The insert of claim 11, wherein the member comprises sufficient lead-equivalent material to attenuate x-rays to substantially the same extent as ½ millimeter of lead.

15. The insert of claim 14, wherein the member comprises a plurality of lead-equivalent vinyl sheets surrounded by a sheath.

16. A radiation-attentuating insert for a glove comprising:

a flexible, generally planar member of lead-equivalent material;

a cloth material secured to the member and substantially overlying the member, the cloth material and the member each at least as large as the palm of a user's hand; and an adjustable length strap connected to the cloth material at spaced apart locations thereon to secure the cloth material and the flexible, generally planar member to the user's hand, wherein the cloth material has a forward edge and the strap is connected to the cloth material to position the forward edge substantially at the base of the fingers when the insert is secured to the user's hand.

17. The insert of claim 16, wherein the cloth material and flexible, generally planar member extend a sufficient distance from the forward edge to cover the user's palm and wrist when the insert is secured to the user's hand.

18. A specially adapted glove for use in radiology procedures comprising:

a surgical glove; and an insert within the glove, the insert comprising: lead-equivalent material corresponding to ½ millimeter of lead protection; a substantially flat case sized to receive the lead-equivalent material therein, the case having a pair of opposite surfaces, the first surface formed of cloth material capable of absorbing perspiration and the second surface formed of cloth material having a sufficiently low coefficient of friction to permit the glove to slide relative to the second surface when the glove is pulled over the second surface under manual force; and an adjustable length strap having a first pair of ends connected to the flat case and a second pair of ends remote from the case, the second ends attachable to each other at one of multiple locations, whereby the insert can be releasably secured to a hand.

19. A surgical glove insert for protecting a hand during procedures involving ionizing radiation, the insert comprising:

a substantially flat, flexible member which substantially inhibits the passage of the radiation therethrough, the member having a surface area which covers a selected portion of the hand likely to be exposed to the radiation, wherein the substantially flat member has a forward edge and a length and a width sufficient to cover at least the metacarpus;

means for releasably securing the member over the hand without reducing dexterity of the fingers; and wherein said flat member has a sufficiently limited profile to permit the wearer to insert the hand with said flat member secured thereto into a surgical glove.

* * * * *